US008779317B2

(12) United States Patent
Kim

(10) Patent No.: US 8,779,317 B2
(45) Date of Patent: Jul. 15, 2014

(54) CONTACT ASSEMBLY FOR VACUUM INTERRUPTER

(75) Inventor: Sung Tae Kim, Chungcheongbuk-Do (KR)

(73) Assignee: LSIS Co., Ltd., Anyang, Gyeonggi-Do (KR)

( * ) Notice: Subject to any disclaimer, the term of this patent is extended or adjusted under 35 U.S.C. 154(b) by 211 days.

(21) Appl. No.: 13/276,231

(22) Filed: Oct. 18, 2011

(65) Prior Publication Data

US 2012/0091101 A1 Apr. 19, 2012

(30) Foreign Application Priority Data

Oct. 18, 2010 (KR) ..... 10-2010-0101553

(51) Int. Cl.

| | |
|---|---|
| ***H01H 33/66*** | (2006.01) |
| ***H01H 33/664*** | (2006.01) |
| *H01H 33/662* | (2006.01) |
| *H01H 1/02* | (2006.01) |

(52) U.S. Cl.

CPC ..... *H01H 33/664* (2013.01); *H01H 33/66261* (2013.01); *H01H 1/0203* (2013.01)

USPC ..... 218/123; 218/118; 218/140

(58) Field of Classification Search

USPC ..... 218/118–140

See application file for complete search history.

(56) References Cited

U.S. PATENT DOCUMENTS

| | | | | |
|---|---|---|---|---|
| 4,473,731 | A * | 9/1984 | Yorita | 218/123 |
| 4,588,879 | A * | 5/1986 | Noda et al. | 218/127 |
| 6,163,002 | A * | 12/2000 | Ahn et al. | 218/123 |
| 6,426,475 | B2 * | 7/2002 | Watanabe et al. | 218/118 |
| 6,506,992 | B2 * | 1/2003 | Kim | 218/123 |
| 6,541,726 | B2 * | 4/2003 | Schellekens et al. | 218/123 |
| 2002/0144977 | A1 * | 10/2002 | Kikuchi et al. | 218/123 |
| 2004/0164051 | A1 | 8/2004 | Stoving et al. | |

FOREIGN PATENT DOCUMENTS

| | | |
|---|---|---|
| CN | 1242589 | 1/2000 |
| CN | 1981354 | 6/2007 |
| JP | 42-17523 | 9/1967 |
| JP | 56-11432 | 1/1981 |
| JP | 61-71517 | 4/1986 |
| JP | 10-321093 | 12/1998 |
| JP | 2003-132769 | 5/2003 |
| JP | 2004039432 | 2/2004 |
| JP | 2008-108572 | 5/2008 |
| JP | 2010-61935 | 3/2010 |
| JP | 2010-86898 | 4/2010 |
| RU | 2178927 | 1/2002 |
| SU | 1345271 | 10/1987 |
| SU | 1700628 | 12/1991 |

OTHER PUBLICATIONS

Japan Patent Office Application Serial No. 2011-227905, Office Action dated Mar. 5, 2013, 3 pages.

Russian Federation Federal Service for Intellectual Property, Patents and Trademarks Application Serial No. 2011141987/07, Office Action dated Dec. 14, 2012, 10 pages.

Russian Federation Federal Service for Intellectual Property, Patents and Trademarks Application Serial No. 2011141987, Notice of Allowance dated May 29, 2013, 6 pages.

The State Intellectual Property Office of the People's Republic of China Application Serial No. 201110319151.X, Office Action dated Nov. 20, 2013, 6 pages.

Japan Patent Office Application Serial No. 2011-227905, Office Action dated Oct. 1, 2013, 1 page.

* cited by examiner

*Primary Examiner* — Truc Nguyen

(74) *Attorney, Agent, or Firm* — Lee, Hong, Degerman, Kang & Waimey

(57) ABSTRACT

The contact assembly for a vacuum interrupter, comprises: a fixed contact; a fixed electrode coupled to the fixed contact; a movable contact movable to a first position at which the movable contact comes into contact with the fixed contact and a second position at which the movable contact is separated from the fixed contact; a movable electrode coupled to the movable contact and movable with the movable contact; and a contact support member installed to be in contact with the movable contact on the circumference of the movable electrode and increase a contact area contacting the movable contact together with the movable electrode in order to reduce stress applied to the movable contact and the movable electrode when the movable contact moves to the first position.

8 Claims, 4 Drawing Sheets

CONTACT ASSEMBLY FOR VACUUM INTERRUPTER

CROSS-REFERENCE TO A RELATED APPLICATION

Pursuant to 35 U.S.C. §119(a), this application claims the benefit of earlier filing date and right of priority to Korean Application No. 10-2010-0101553, filed on Oct. 18, 2010, the contents of which is incorporated by reference herein in its entirety.

BACKGROUND OF THE INVENTION

1. Field of the Invention

The present invention relates to a vacuum interrupter and, more particularly, to a contact assembly for a vacuum interrupter having excellent mechanical tolerance against a mechanical impact of contacts according to switching the contacts.

2. Description of the Related Art

A vacuum interrupter is a switching contact and arc-extinguishing unit used as a core component of an electric power device such as a vacuum circuit breaker, a vacuum switch, a vacuum contactor, or the like, in order to break an electric load current or a fault current in an electric power system.

Among such application devices of the vacuum interrupter, the vacuum circuit breaker serves to protect an electric load in power transmission controlling and the electric power system, and since the vacuum circuit breaker has many advantages that it has a large breaking capacity (voltage/current) and high operational reliability and stability and can be mounted in a small space, the vacuum circuit breaker has been extensively applied in voltage environments from a middle voltage to a high voltage. Also, the breaking capacity of the vacuum circuit breaker is proportionally increasing in line with the increase in the size of industrial facilities.

A configuration example of the vacuum interrupter in a vacuum circuit breaker will be described with reference to FIG. 1 as follows.

As shown in FIG. 1, generally, a vacuum interrupter 10 comprises an insulating container 9 made of a ceramic material having excellent electrical insulating properties and heat resistance and having open upper and lower portions, a fixed electrode 4 insertedly positioned in the insulating container 9 and having one end portion to which a fixed contact 3 is coupled through, for example, welding and the other end portion electrically connected to, for example, an electric power source, and a movable electrode 1 insertedly positioned in the insulating container 9 and having one end portion to which a movable contact 2 is coupled through, for example, welding and the other end portion electrically connected to, for example, an electrical load. Reference numeral 5 designates an air-tight bellows made of a metal and movably supporting the movable electrode 1, and reference numeral 6 designates a shielding plate installed at the movable electrode 1 to shield and protect the air-tight bellows 5 against arc. Reference numeral 7 designates a first seal cup welded to the insulating container 9 so as to be fixedly installed to hermetically close a gap between the lower open portion and the movable electrode 1. Reference numeral 8 designates a second seal cup welded to the insulating container 9 so as to be fixedly installed to hermetically close a gap between the upper open portion and the fixed electrode 4. Reference numeral 10 designates a central shielding plate installed at the center of the insulating container 9 in order to protect an inner wall face of the insulating container 9 against arc.

The general vacuum interrupter 10 configured as described above may be connected to an actuator including a driving source (not shown) such as a spring or a motor and a link mechanism 13. The movable electrode 1 may be electrically connected with an electric power line (circuit) of the load side through a terminal 12, and the fixed electrode 4 may be electrically connected with an electric power line (circuit) of an electrical power source side through a terminal 11.

In FIG. 1, reference numeral 14 designates an outer case of the vacuum circuit breaker and reference numeral 15 designates wheels for moving the vacuum circuit breaker.

In FIG. 1, when the movable electrode 1 is lifted according to a transmission of driving force (or power) from the link mechanism 13 of the actuator, the movable contact 2 installed at one end portion of the movable electrode 1 is brought into contact with the fixed contact 3, causing the power source electrically connected to the movable electrode 1 through the terminal 12 and the load electrically connected to the fixed electrode 4 through the terminal 11 to be connected into an operational state in which the electric power circuit becomes a closed circuit.

In FIG. 1, when the movable electrode 1 is lowered according to transfer of driving force from the actuator including the driving source (not shown) such as a spring or a motor and the link mechanism 13, the movable contact 2 installed at one end portion of the movable electrode 1 is separated from the fixed contact 3, electrically disconnecting the electrical load electrically connected with the movable electrode 1 and the electrical power source electrically connected with the fixed electrode, into an operation state in which the circuit is open.

In the operation of closing the circuit, as shown in FIG. 2, current I flows through the movable electrode 1, the movable contact 2, the fixed contact 3, and the fixed electrode 4. In FIG. 2, reference numerals 3*a* and 2*a* designate splash shields for protecting a rear portion of the contacts against metal vapor of an arc generated when the contacts are open.

In case in which the movable contact 2 and the fixed contact 3 has a spiral shape, an arc generated between the movable contact 2 and the fixed contact 3 when the movable contact 2 and the fixed contact 3 are open is pushed to an outer side, upon receiving force (F) in FIG. 2, which is called Lorentz force according to Fleming's left hand rule, by a current flow in a vertical direction and a corresponding horizontal magnetic field, rotated to be dispersed and become extinct, Meanwhile, in case of the related art vacuum interrupter as described above, both the movable contact 2 and the fixed contact 3 receive mechanical stress during opening and closing operation. In particular, in the case of the vacuum interrupter employing a spiral contact structure, as shown in FIG. 3, a horizontal sectional area of a contact portion SA at the fixed electrode 4 and the movable electrode 1 supporting a lower end portion of the contact is preferably required to be smaller than a contact area (i.e., the area of the contact portion with which the movable contact or the fixed contact is brought into contact) at the movable contact 2 or the fixed contact 3 in order to obtain stronger Lorentz force (F) for driving arc in the horizontal direction at an initial stage of cutting off (or breaking) a fault current, which is, then more advantageous to cut off (or break) a large current. This is because, as the difference between the contact area at the movable contact 2 or the fixed contact 3 and the horizontal sectional area of the movable electrode 1 or the fixed electrode 4 is increased, Lorentz force (F) at the initial stage of opening the contacts is increased.

However, in case of the contact area of the contacts, there is a limitation in increasing the contact area to secure an insulating distance from an internal component such as the central shielding plate 10, or the like, of the vacuum interrupter. Also, the increase in the sectional area of the fixed electrode 4 and the movable electrode 1 supporting the contact lower end portion is also inevitably limited.

For those reasons, when the related art vacuum interrupter performs closing operation, the mechanical stress according to the contact impact between the contacts is applied to the movable contact 2 and the fixed contact 3, causing the contacts to be mechanically deformed.

When operating energy is increased in order to break the large current, the contact portions are severely deformed in proportion to the increased closing energy, which leads to a possibility in which the original function (insulation, arc-extinguishing, and electrical connection) of the vacuum interrupter is damaged.

Thus, reinforcing of the strength of the contact portions of the vacuum interrupter according to the increase in the capacity of the vacuum circuit breaker is urgently required.

SUMMARY OF THE INVENTION

An aspect of the present invention provides a contact assembly of a vacuum interrupter capable of preventing a contact portion of the vacuum interrupter from being weakened or damaged by powerful stress applied to the contact portion due to closing energy which increases according to an increase in size of a vacuum circuit breaker.

Another aspect of the present invention provides a contact assembly of a vacuum interrupter capable of preventing degradation of performance of breaking a fault current.

According to an aspect of the present invention, there is provided a contact assembly for a vacuum interrupter, comprising: a fixed contact; a fixed electrode coupled to the fixed contact; a movable contact movable to a first position at which the movable contact comes into contact with the fixed contact and a second position at which the movable contact is separated from the fixed contact; a movable electrode coupled to the movable contact and movable with the movable contact; and a contact support member installed to be in contact with the movable contact on the circumference of the movable electrode and increase a contact area contacting the movable contact together with the movable electrode in order to reduce stress applied to the movable contact and the movable electrode when the movable contact moves to the first position.

The contact assembly may further include a contact support member installed to be in contact with the fixed contact on the circumference of the fixed electrode to increase a contact area contacting with the fixed contact together with the fixed electrode.

The contact support members may be made of a material having high electrical resistance compared with a material of the movable electrode and the fixed electrode.

The movable electrode and the fixed electrode may be made of oxygen free copper, and the contact support members may be made of stainless steel.

The contact support members may be configured as hollow tubular members allowing the movable electrode or the fixed electrode to pass therethrough.

The foregoing and other objects, features, aspects and advantages of the present invention will become more apparent from the following detailed description of the present invention when taken in conjunction with the accompanying drawings.

DETAILED DESCRIPTION OF THE INVENTION

The foregoing and other objects, features, aspects and advantages of the present invention will become more apparent from the following detailed description of the present invention when taken in conjunction with the accompanying drawings.

Figure 4:
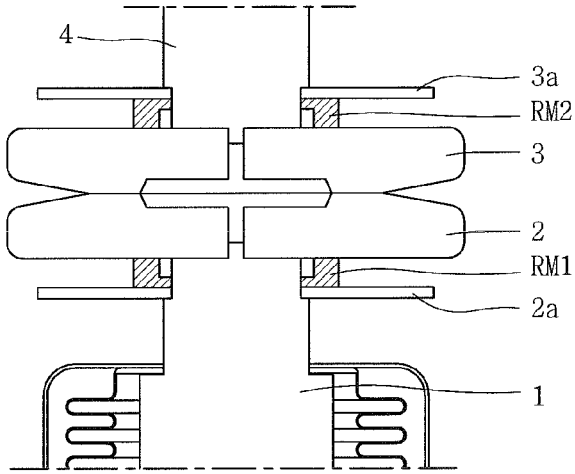
FIG. 4 is a vertical sectional view showing the configuration of a contact assembly of a vacuum interrupter according to a preferred embodiment of the present invention.

As shown in FIG. 4, a contact assembly for a vacuum interrupter according to a preferred embodiment of the present invention comprises a fixed contact 3, a fixed electrode 4, a movable contact 2, a movable electrode 1, and contact support members RM1 and RM2. In FIG. 4, reference numerals 3*a* and 2*a* designate splash shields 9 for protecting a rear side of the contacts against metal vapor of an arc generated when the contacts are open.

The fixed contact 3 may be electrically connected to an electrical power source or an electrical load of an electrical power circuit through the fixed electrode 4.

Figure 1:
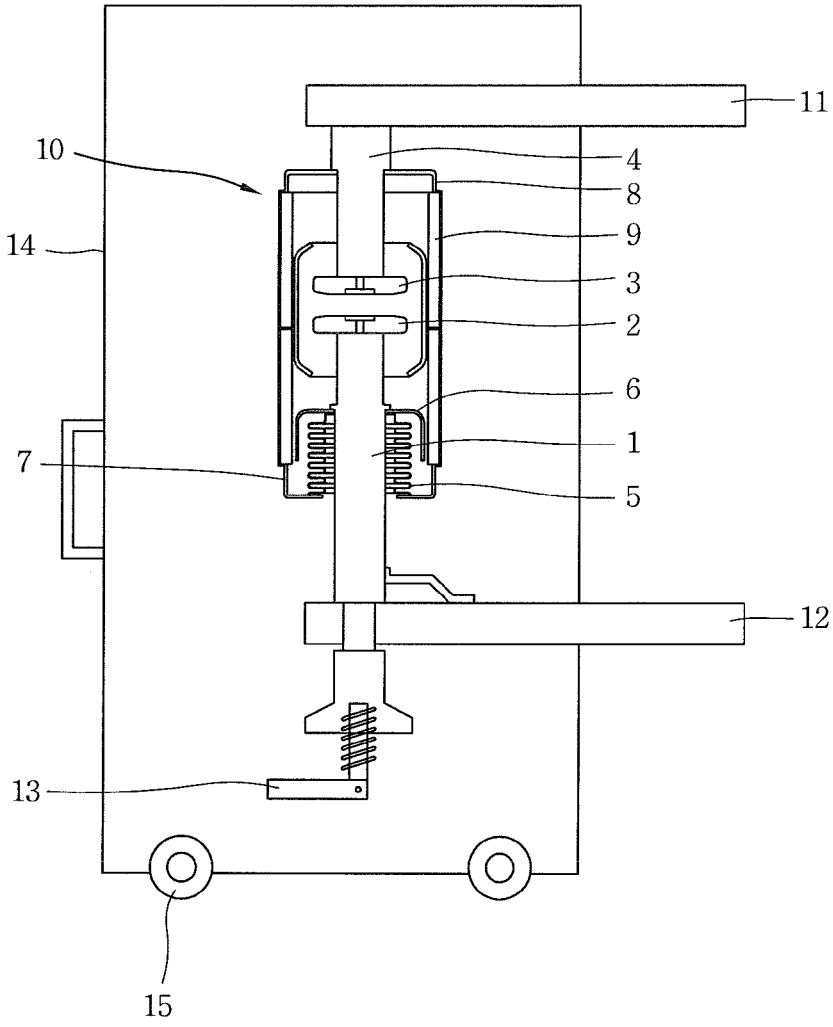
FIG. 1 RELATED ART
FIG. 1 is a vertical sectional view of a vacuum circuit breaker schematically showing the configuration of a vacuum circuit breaker including a vacuum interrupter according to the related art.
Figure 2:
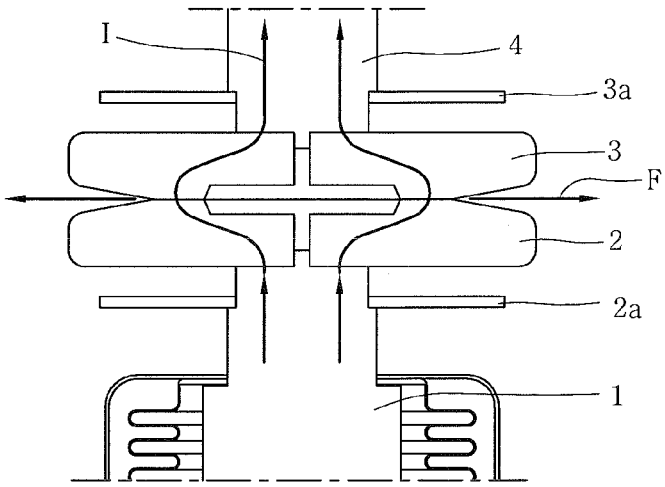
FIG. 2 RELATED ART
FIG. 2 is a view showing a major part of a contact assembly of the vacuum interrupter showing the direction of a current and the direction of Lorentz force according to the related art.
Figure 3:
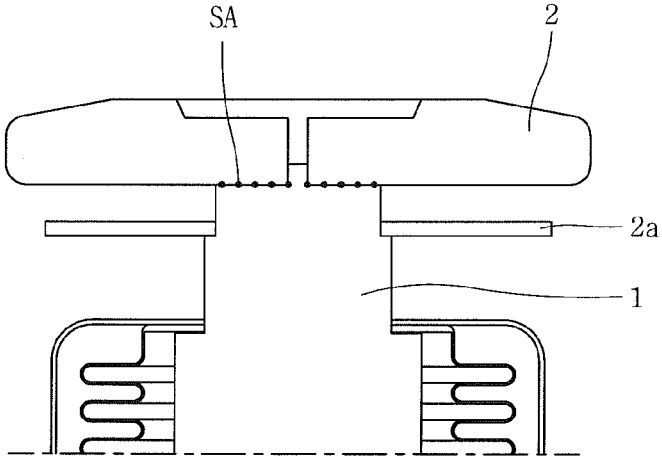
FIG. 3 RELATED ART
FIG. 3 is a view showing a major part of the contact assembly of the vacuum interrupter showing a portion of the electrode where stress is generated when contacts are brought into contact according to the related art.

The fixed electrode 4 is coupled to the fixed contact 3 through welding, or the like, and may be electrically connected with the electrical power source or the electrical load of the electrical power circuit through the terminals (11 and 12 in FIG. 1), and a cable (not shown).

The movable contact 2 may be movable to a first position at which the movable contact 2 is brought into contact with the fixed contact 3, or to a second position at which the movable contact 2 is separated from the fixed contact 3. The movable contact 2 is made of an electrically conductive material.

The movable contact 1 is coupled to the movable contact 2 through welding, or the like, and drives the movable contact to move to the first or second position. The driving force (or power) of the movable electrode 1 is provided by a driving source (not shown) such as a driving spring or a motor and a power transfer mechanism (not shown) such as links for transferring driving force from the driving source to the movable electrode 1.

Among the contact support members RM1 and RM2, the first contact support member RM1 is installed on the circumference of the movable electrode 1 to increase a contact area contacting the movable contact 2 together with the movable electrode 1, so that stress applied to the movable contact 2 and the movable electrode 1 can be reduced when the movable contact 2 is moved to the first position. The reason for installing the first contact support member RM1 on the circumference of the movable electrode 1 to increase the contact area contacting the movable contact 2 is because, the stress is in proportion to an applied load (pressure) and in inverse proportion to the contact area. Namely, when the contact area is large, the load (pressure) is dispersed as much, thus reducing the stress generated from the portion which receives load (pressure). This can be expressed by Equation (1) shown below:

$$\sigma = \frac{F}{A} \tag{1}$$

In Equation (1), σ is stress, F is a load (pressure), and A is a contact area.

Figure 5:
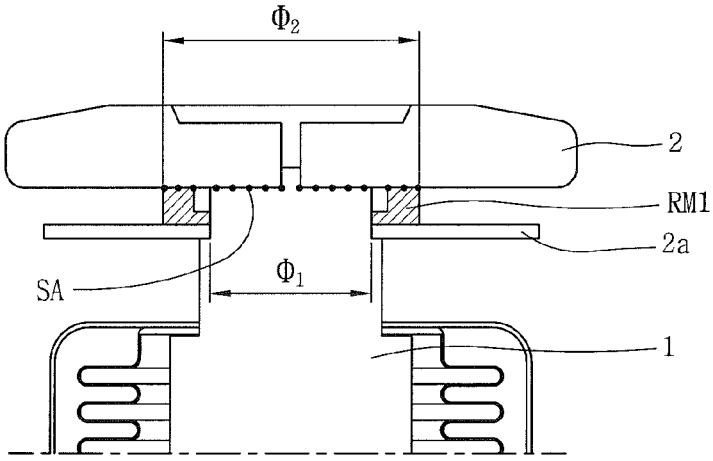
FIG. 5 is a view showing a major part showing that the area of the portion where stress is generated is increased in the contact assembly of the vacuum interrupter, in comparison to the related art, according to an embodiment of the present invention.

As shown in FIG. 5, in the related art, the contact area between the movable electrode 1 and the movable contact 2 is as small as the first contact area Φ1, while in the contact assembly of the vacuum interrupter according to an embodiment of the present invention, since the first contact support member RM1 installed on the circumference of the movable electrode 1 is in contact with a lower surface of the movable contact 2 together with the movable electrode 1, the contact area is increased into Φ2. Namely, according to the present invention, when the movable contact 2 moves to the first position, the stress generated at the movable electrode 1 and the movable contact 2 is reduced to be in inverse proportion according to the increase in the contact area of the contact portion SA as can refer to Equation 1.

In the contact assembly of the vacuum interrupter according to an embodiment of the present invention as illustrated in FIG. 4, among the contact support members RM1 and RM2, the second contact support member RM2 is installed on the circumference of the fixed electrode 4, increasing the contact area contacting the fixed contact 3 together with the fixed electrode 4. Thus, according to the present invention, when the movable contact 2 moves to the first position, stress generated at the fixed electrode 4 and the fixed contact 3 is reduced in inverse proportion according to the increase in the contact area as can refer to Equation 1.

The contact support members RM1 and RM2 may be configured as short hollow tubular members to allow the movable electrode 1 or the fixed electrode 4 to pass therethrough. Since the contact support members RM1 and RM2 are configured as the hollow tubular members, they can be easily installed on the circumference of the movable electrode 1 or the fixed electrode 4.

Figure 6:
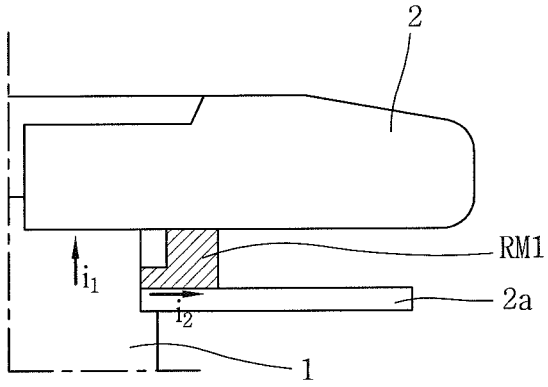
FIG. 6 is a view showing the comparison in the amount of currents flowing through an electrode and a contact supporting member in the contact assembly of the vacuum interrupter according to an embodiment of the present invention.

Meanwhile, the contact assembly of the vacuum interrupter according to an embodiment of the present invention has the following configuration characteristics in order to prevent a degradation of performance for breaking a fault current. Namely, the contact support members RM1 and RM2 are made of a material having high electrical resistance compared with the material of the movable electrode 1 and the fixed electrode 4. Thus, since the electrical resistance of the material of the contact support members RM1 and RM2 is much larger than the electrical resistance of the movable electrode 1 and the fixed electrode 4, as shown in FIG. 6, the amount of current $i_2$ flowing through the first contact support member RM1 can be negligible compared with the amount of current $i_1$ flowing through the movable contact 2 through the movable electrode 1, and thus, sufficient proportional magnetic field and Lorentz force are generated owing to the sufficient amount of current i1 between the contacts. Accordingly, in performing a breaking operation (in other words contacts opening and separating operation) with respect to a fault current, an arc generated between the contacts can be pushed out of the contacts and rotated so as to be quickly extinguished by the sufficient Lorentz force. Therefore, the contact assembly for the vacuum interrupter according to the present invention can also prevent a degradation of performance of breaking a fault current.

In the contact assembly for the vacuum interrupter according to a preferred embodiment of the present invention, the movable electrode 1 and the fixed electrode 4 may be made of oxygen free copper, and the contact support members RM1 and RM2 may be made of stainless steel.

A closing operation and an opening operation (contacts opening and separating operation) in the contact assembly of the vacuum interrupter according to an embodiment of the present invention will be described.

In a closing operation, driving force from a power transfer mechanism such as links (not shown), which transfers power from a driving power source such as a driving spring or a motor, is transferred to the movable electrode 1, the movable electrode 1 is lifted. Then, as shown in FIG. 4, the movable contact 2 coupled to an upper end portion of the movable electrode 1 is brought into contact with the fixed contact 3 which is disposed to face the movable contact 2, forming a circuit path through the movable electrode 1, the movable contact 2, the fixed contact 3, and the fixed electrode 4 to allow current to flow therethrough, thus completing the closing operation. In this case, in the contact assembly for the vacuum interrupter according to the present invention as shown in FIG. 4, the contact support members RM1 and RM2 are installed on the circumference of the fixed electrode 4 and the movable electrode 1 to increase a contact area contacting the fixed contact 3 together with the fixed electrode 4 and increase a contact area contacting the movable contact 2 together with the movable electrode 1. Thus, according to the present embodiment, when the movable contact 2 moves to the first position, stress generated at the fixed electrode 4, the fixed contact 3, the movable electrode 1, and the movable contact 2 can be reduced inverse-proportionally as noted with reference to Equation 1 shown above. Accordingly, the possibility in which the fixed contact 3 and the movable contact 2 are deformed and damaged can be reduced as much.

In an opening operation, driving force from a power transfer mechanism such as links (not shown), which transfers driving force from a driving power source such as a driving spring or a motor, is transferred to the movable electrode 1, the movable electrode 1 is lowered. Then, as shown in FIG. 4, the movable contact 2 coupled to an upper end portion of the movable electrode 1 is separated from the fixed contact 3 which is disposed to face the movable contact 2, disconnecting the circuit path through the movable electrode 1, the movable contact 2, the fixed contact 3, and the fixed electrode 4 to prevent current from flowing therethrough, thus completing the opening operation. In this case, in the contact assembly of the vacuum interrupter according to the present invention, since the contact support members RM1 and RM2 are made of a material having high electrical resistance compared with that of the fixed electrode 4 or the movable electrode 1, most current can flow toward the fixed contact 3 and the movable contact 2 through the fixed electrode 4 or the movable electrode 1, rather than to the contact support members RM1 and RM2. Thus, owing to the sufficient amount of current between the contacts, sufficient proportional magnetic field and Lorentz force are generated, and thus, in performing the opening operation (in other words contacts opening and separating operation) with respect to a fault current, an arc generated between the contacts can be pushed out of the contacts and rotated so as to be quickly extinguished by the sufficient Lorentz force.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A contact assembly for a vacuum interrupter, the assembly configured to cause a current flowing from a movable contact to a fixed contact to bend around a space generated between a recessed portion of a surface of the movable contact and a recessed portion of a surface of the fixed contact and comprising:

a fixed electrode coupled to and contacting the fixed contact, the fixed electrode having a diameter smaller than a diameter of the fixed contact;

a movable contact configured to move to a first position in which the movable contact comes into contact with the fixed contact and into a second position in which the movable contact is separated from the fixed contact;

a movable electrode coupled to and contacting the movable contact, the movable electrode having a diameter smaller than a diameter of the movable contact; and a plurality of contact support members, a first of the plurality of contact support members arranged between the fixed contact and the fixed electrode and a second of the plurality of the contact members arranged between the movable contact and the movable electrode, wherein each one of the plurality of contact support members covers a body of the fixed electrode or a body of the movable electrode, and wherein an outer diameter of the first of the plurality of contact support members is greater than the diameter of the fixed electrode and an outer diameter of the second of the plurality of contact support members is greater than the diameter of the movable electrode such that a first contact area between the fixed contact and the fixed electrode and a second contact area between the movable contact and the movable electrode are increased and stress concentration at the first contact area and second contact area is reduced by spreading stress over the increased first contract area and second contact area.

2. The contact assembly of claim 1, wherein the plurality of contact support members are made of a material having higher electrical resistance than a material of which the movable electrode and the fixed electrode are made.

3. The contact assembly of claim 1, wherein:

the movable electrode and the fixed electrode comprise oxygen free copper; and the first contact support member comprises stainless steel.

4. The contact assembly of claim 2, wherein:

the movable electrode and the fixed electrode comprise oxygen free copper; and the first contact support member comprises stainless steel.

5. The contact assembly of claim 1, wherein the plurality of contact support members are configured as hollow tubular members to allow the movable electrode or the fixed electrode to pass therethrough.

6. The contact assembly of claim 2, wherein the plurality of contact support members are configured as hollow tubular members allowing the movable electrode or the fixed electrode to pass therethrough.

7. The contact assembly of claim 1, further comprising:

a plurality of splash shields, wherein a first of the plurality of splash shields surrounds an outer side surface of the fixed electrode, has a hollow ring shape and is spaced from a head of the fixed contact, and wherein a second of the plurality of splash shields surrounds an outer side surface of the movable electrode, has a hollow shape and is spaced from a bottom end of the movable contact.

8. The contact assembly of claim 7, wherein each of the plurality of contact support members is arranged between the first of the plurality of splash shields and the fixed electrode and between the second one of the plurality of splash shields and the movable electrode.

* * * * *